US009675131B2

(12) United States Patent
Gould et al.

(10) Patent No.: US 9,675,131 B2
(45) Date of Patent: Jun. 13, 2017

(54) METATARSAL GUARDS FOR FOOTWEAR

(71) Applicant: Wolverine World Wide, Inc., Rockford, MI (US)

(72) Inventors: Matthew L. Gould, Rodney, MI (US); Eric P. Fracassi, Grandville, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 97 days.

(21) Appl. No.: 14/831,484

(22) Filed: Aug. 20, 2015

(65) Prior Publication Data

US 2016/0331072 A1 Nov. 17, 2016

Related U.S. Application Data

(60) Provisional application No. 62/159,707, filed on May 11, 2015.

(51) Int. Cl.

| | |
|---|---|
| ***A43B 23/26*** | (2006.01) |
| ***A43B 7/32*** | (2006.01) |
| ***A43B 23/08*** | (2006.01) |
| ***A43C 13/14*** | (2006.01) |

(52) U.S. Cl.

CPC ..... *A43B 7/32* (2013.01); *A43B 23/082* (2013.01); *A43C 13/14* (2013.01)

(58) Field of Classification Search

CPC ..... A43B 7/32; A43B 23/081–23/087; A43C 13/14

See application file for complete search history.

(56) References Cited

U.S. PATENT DOCUMENTS

| | | | | |
|---|---|---|---|---|
| 2,842,872 A * | 7/1958 | Shultz | A43B 7/32 36/72 R |
| 3,175,310 A * | 3/1965 | MacQuaid | A43B 7/32 36/72 R |
| 3,334,427 A * | 8/1967 | Edwards | A43B 23/26 36/72 R |
| 3,470,630 A | 10/1969 | Wilmanns et al. | |
| 3,561,142 A | 2/1971 | Streit, Sr. et al. | |

(Continued)

OTHER PUBLICATIONS

And, Metatarsal Guard Safety Shoes, download from http://golapitt.tumblr.com/metatarsal-guard-safety-shoes, dated Jun. 30, 2015.

(Continued)

*Primary Examiner* — Jila M Mohandesi

(74) *Attorney, Agent, or Firm* — Warner Norcross & Judd LLP

(57) ABSTRACT

Safety footwear adapted to provide protection to the instep region and/or metatarsals of a wearer is provided, including an internal metatarsal guard disposed in an interior of an upper, a first external metatarsal guard joined with the exterior of the upper, and optionally a second external metatarsal guard joined with the exterior of the upper, and overlapping the first external metatarsal guard. Upon flexing of the instep region during a gait cycle of a wearer, the second external metatarsal guard can ride along the first external metatarsal guard in a lobster tail articulation. The footwear and its components provide impact and crushing force resistance, yet the footwear is flexible enough to provide enhanced mobility to a wearer.

19 Claims, 8 Drawing Sheets

(56) References Cited

U.S. PATENT DOCUMENTS

| | | | | |
|---|---|---|---|---|
| 4,231,170 | A * | 11/1980 | Griswold | A43B 3/16 36/72 R |
| 5,711,092 | A * | 1/1998 | Despres | A43C 13/14 36/133 |
| 2001/0022039 | A1 | 9/2001 | Krajcir | |
| 2006/0021256 | A1* | 2/2006 | Hess | A43B 7/32 36/72 R |
| 2012/0255203 | A1* | 10/2012 | Booth | A43B 5/1666 36/99 |

OTHER PUBLICATIONS

SafetyCompany Metatarsal Guard by Kanga Tuff, download from http://www.safetycompany.com/products/metatarsal-guard-by-kanga-tuff.html?gclid=CKfcx4__gtcYCFQGUaQodlkEJsQ, dated Jun. 30, 2015.

ESafety Supplies Onguard Metatarsal Guard with Spring Fastener, Model 801, download from http://www.esafetysupplies.com/Onguard-Metatarsal-Guard-with-Spring-Fastener-Model-801.html?gclid=CNa35JngtcYCFQYJaQodSeUBGA, dated Jun. 30, 2015.

Chet's Safety Supply Keen Utility—6 Inch Steel Toe Work Boot with external Metatarsal Guard, download from http://www.chetssafety supply.com/browse.cfm/keen-utility-6-inch-steel-toe-work-boot-with-external-metatarsal-guard/4,1072.html, dated Jun. 30, 2015.

Impacto Metguard LaceUp Metatarsal Guard, Universal, Pr 1 (2010).

* cited by examiner

METATARSAL GUARDS FOR FOOTWEAR

BACKGROUND OF THE INVENTION

The present invention relates to footwear, and more particularly to safety footwear including metatarsal guards.

The human foot includes many bones that can be subject to crushing forces when impacted by falling or dropped items. For example, the foot includes multiple elongated metatarsal bones extending alongside one another in the instep region which extends forwardly from the front of the ankle to the base of the toes. These bones are particularly vulnerable to fracture when impacted by falling objects. In the United States, over 100,000 individuals are injured annually due to such accidents, some being severely incapacitated or maimed.

Many manufacturers produce footwear designed to prevent injuries to the metatarsals and instep region in general. Such footwear typically includes an external metatarsal guard. An external metatarsal guard usually includes a rigid, durable, synthetic plastic or metal shield placed over the exterior of the footwear to cover the instep region of the foot. Sometimes, the shield is concealed by a fabric or leather cover that matches the remainder of the footwear. The front edge of the external metatarsal guard usually is fastened via stitching, staples or other fasteners to a welt, outsole or periphery of the footwear around the toes. This can ensure consistent positioning of the shield over the metatarsal bones, and thus constant protection of those bones.

An issue with some external metatarsal guards, however, is that they can limit mobility, and can make the appearance of the footwear unsightly. Specifically, the rigid external shield can impair the range of motion of the foot during a natural walking or running gait. The rigid external shield also can pinch the instep when a wearer bends or squats. In cases of particularly large or poorly designed external shields, they can create a snagging or tripping hazard, perhaps causing injury.

In an effort to avoid the above issues with a conventional external metatarsal guard, some footwear manufacturers alternatively produce footwear with an internal metatarsal guard to compete against other footwear including the external metatarsal guard. An internal metatarsal guard usually is incorporated directly into the instep of the footwear, concealed by the fabric or leather of the footwear in the instep. The internal metatarsal guard can include a shield constructed from a semi rigid foam that is generally flexible but impact resistant. The internal metatarsal shield is generally completely concealed within the footwear. Because it is semi rigid, it can flex, providing the user with more mobility and flexion throughout the instep. While this is helpful, sometimes an internal metatarsal guard can offer slightly less protection than the external metatarsal guard rigid shield, which is a trade-off of flexibility for protection between the competing technologies.

Accordingly, there remains room for improvement in the field of metatarsal guards that protect the metatarsal bones and instep of a wearer's foot from forceful impacts, and simultaneously provides comfort, flexibility and reliability in an aesthetically pleasing package.

SUMMARY OF THE INVENTION

Footwear is provided including a hybrid metatarsal guard system having an external metatarsal guard and an internal metatarsal guard. The external metatarsal guard optionally can include first and second overlapping metatarsal guard plates that articulate relative to one another like a lobster tail, with one or both of the plates overlapping the internal metatarsal guard. The footwear and its components provide impact and crushing force resistance, yet the footwear is flexible enough to provide enhanced mobility to a wearer.

In one embodiment, the footwear includes an internal metatarsal guard plate constructed from an open cell, breathable foam. The internal metatarsal guard plate is located on the interior of the upper, and extends generally over the instep region and/or metatarsal bones of a wearer when the footwear is worn.

In another embodiment, the internal metatarsal guard plate is overlapped by one or both of first and second external metatarsal guard plates. The first metatarsal guard can overlap a first portion of the internal metatarsal guard and the second metatarsal guard can overlap a second portion of the internal metatarsal guard.

In still another embodiment, the first and second external metatarsal guard plates can be constructed from a rigid thermoplastic material. The plates can be generally concave, with the instep region of the upper projecting upwardly into a concave recess formed on undersides of the plates. One or both of the external metatarsal guard plates can include a front edge, an opposing rear edge, a medial edge and an opposing lateral edge. The medial and lateral edges can extend between the front edge and the rear edge. In both metatarsal guards, the front edge can be closer to the toe region than the respective opposing rear edge.

In even another embodiment, the front edges of the external metatarsal guards can be free from attachment to the upper. The front edge of the second external metatarsal guard also can be free from attachment to the exterior surface of the first external metatarsal guard. In use, the front edge of the second external metatarsal guard can slide or move over an exterior surface of the first external metatarsal guard.

In yet another embodiment, the first and second metatarsal guards can be joined with the upper substantially only via shoe laces that close the upper in normal use. For example, the rear edge of the first external metatarsal guard can be joined via a shoe lace to the upper. At least one of the rear edge, a medial edge and a lateral edge of the second external metatarsal guard can be joined via the same shoe lace to the upper, In a further embodiment, the second external metatarsal guard can include an upwardly extending wall near the front edge of that guard. The wall can transition to a keeper plate. The wall and the keeper plate collectively can define a keeper recess that is formed on an underside of the second external metatarsal guard. Optionally, a portion of the first external metatarsal guard, for example, the first rear edge, can be disposed in the keeper recess when the footwear is in a flat mode.

In still a further embodiment, one or both of the external metatarsal guards can define a plurality of grooves that enhance the flexibility of the guards when the foot flexes during a gait cycle of the wearer. The grooves can be defined on the front surfaces of the guards only, so that flexion is enhanced forwardly, while deflection capability of the guard generally is uncompromised.

The footwear of the current embodiments provides a metatarsal guard assembly having exceptional impact absorption and clearance above the wearer's foot after impact by an object. In turn, this can provide enhanced protection to the metatarsal bones and instep region of the wearer's foot. In addition, the metatarsal guard assembly, with its overlapping, articulating parts, is exceptionally flexible, allowing the foot to follow a more natural range of motion during a gait cycle of the wearer.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
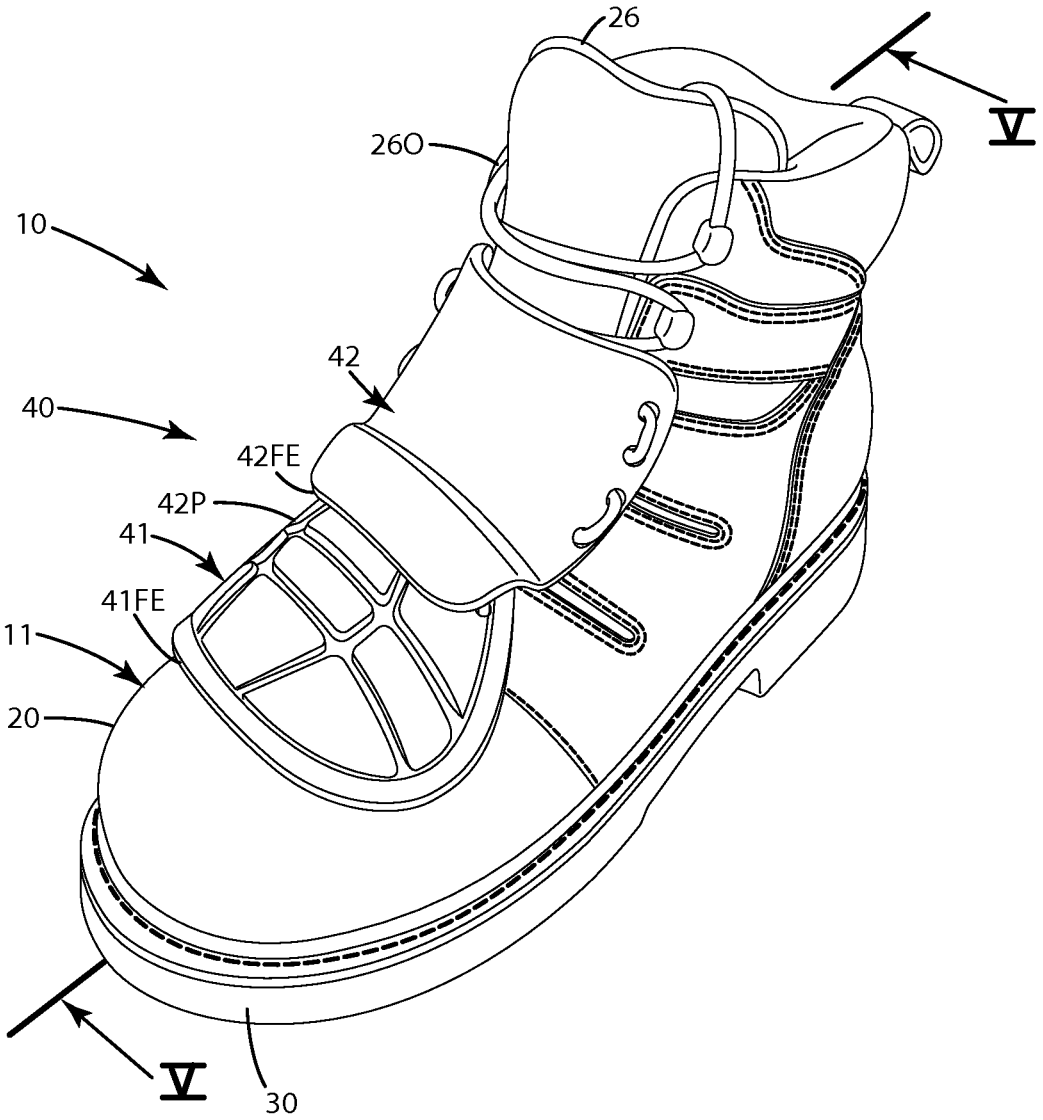
FIG. 1 is a perspective view of footwear of the current embodiments including a metatarsal guard assembly.

An article of footwear in accordance with the current embodiment is shown in FIGS. 1-7 and generally designated 10. The footwear includes an upper 20 that is joined with an outsole 30. The footwear 10 also includes a metatarsal guard assembly 40.

Figure 5:
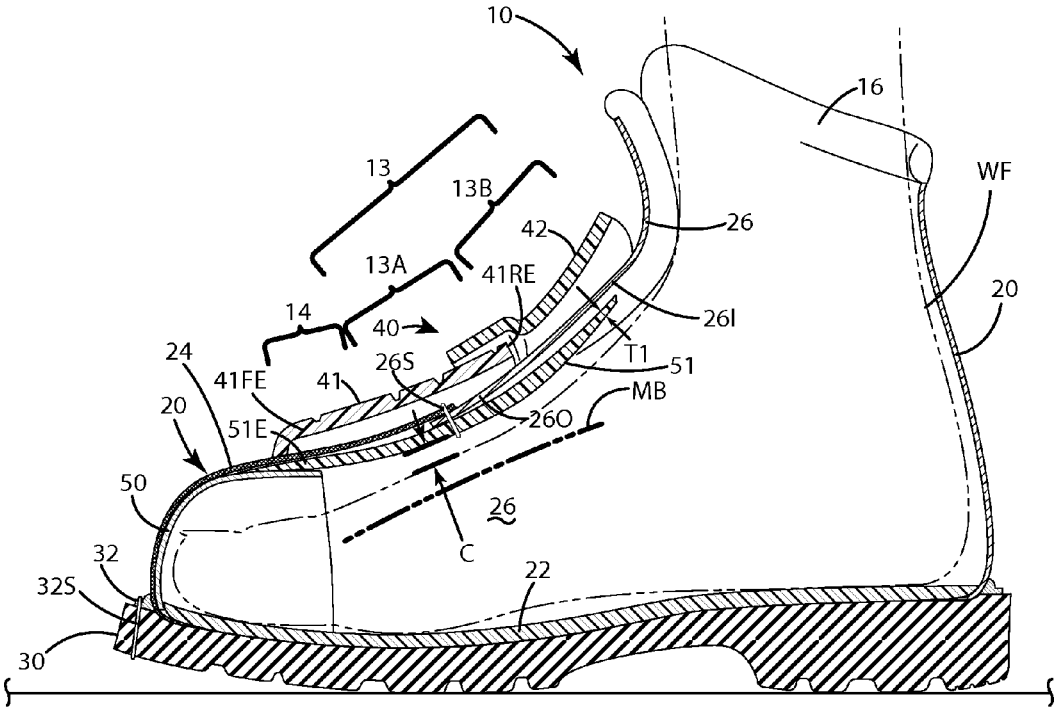
FIG. 5 is a section view of the footwear including the metatarsal guard assembly taken along lines 5-5 of FIG. 4, with the footwear in a generally flat, unflexed mode.

A portion of this metatarsal guard assembly is disposed on the exterior 11 of the footwear 10, while another portion is disposed on the interior 21 of the upper 20 as shown in FIG. 5. For example, the metatarsal guard assembly 40 can include a first external metatarsal guard plate 41 on the exterior 11 of the upper 20. In addition, the metatarsal guard assembly 40 can include an internal metatarsal guard 51 on the interior 21 of the upper 20. With both an external and internal metatarsal guard, it has been discovered that the overall impact absorption in the instep region 13 can be substantially increased.

Optionally, the metatarsal guard system 40 can also include a second external metatarsal guard plate 42. This plate 42 can overlap at least a portion of the first external metatarsal guard plate 41, and can be on the exterior 11 of the footwear 10. The second metatarsal guard plate 42 can move with a lobster tail like articulation relative to the first metatarsal guard. For example, in a lobster tail articulation, a free front edge 42FE of the second external metatarsal guard can slide and move freely over the upper surface or exterior surface 41U of the first external metatarsal guard 41. The front edge 41FE of the first external metatarsal guard 41 also can be free relative to the upper 20 and its exterior surface. Thus, both front edges of both plates can be free to move and slide over the exterior surface of the upper or the exterior surface of the first external metatarsal guard. This type of movement mimics the different sections of a lobster tail during movement so that no region of the upper is exposed through the respective first and second external metatarsal guards. This provides enhanced, consistent protection to the underlying upper and instep region 13 of the footwear, which in turn provides protection to the underlying metatarsal bones MB in that instep region 13.

Although the current embodiments are illustrated in the context of a working boot or safety shoe, they may be incorporated into any type or style of footwear, including performance shoes, hiking shoes, trail shoes and boots, hiking boots, all-terrain shoes, barefoot running shoes, athletic shoes, running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot 17, arch or midfoot 18 and heel 19 region are generally identified in FIG. 4, however, it is to be understood that delineation of these regions may vary depending upon the configuration of the sole assembly and footwear.

As shown in FIG. 5, the upper 20 optionally is of a Strobel construction in which the foot-receiving upper interior 21 is closed on its bottom or lowermost portion by a Strobel board, an insole board, sock or liner 22 or other similar component. Although not shown, the footwear 10 can include a footbed and/or other upper components with the footbed fitted into the upper 10.

For purposes of disclosure, the embodiments herein are described in connection with footwear in the form of a work boot 10 having an upper 20, which as mentioned above, optionally can include a Strobel construction. The upper 20 is joined with the outsole 30. The joining of the outsole 30 and the upper 20 can be accomplished using adhesives, cement, injection molding, pour molding or any other technique used to join an upper and outsole. As illustrated, the insole board or liner 22 can rest or be placed immediately adjacent the outsole 30.

Optionally, the footwear 10 can include a welted construction in which a welt 32 is used to join the upper 20 to the outsole 30. If desired, a stitch 32S can extend through the welt 32 as well as the outsole 30. Of course, other constructions can be used to attach the outsole 30 to the upper 20.

The outsole 30 can be disposed below the upper 20 and any optional midsole included in the construction. The outsole 30 can be constructed from one or more materials. The current embodiment can be constructed from rubber and can include lugs, tread, or other gripping elements. Alternatively, it can be constructed from a thermoplastic polyurethane elastomer (TPU), nylon or other polymer blend that includes nylon and/or TPU. Of course, the outsole can be constructed from any relatively wear resistant polymer, elastomer and/or natural or synthetic rubber or other materials capable of providing the desired functional characteristics. Other materials such as fiber-reinforced polymers can be used. These can include epoxy, polyethylene, polyester, thermosetting plastic reinforced with carbon, glass and/or aramid fibers.

Figure 3:
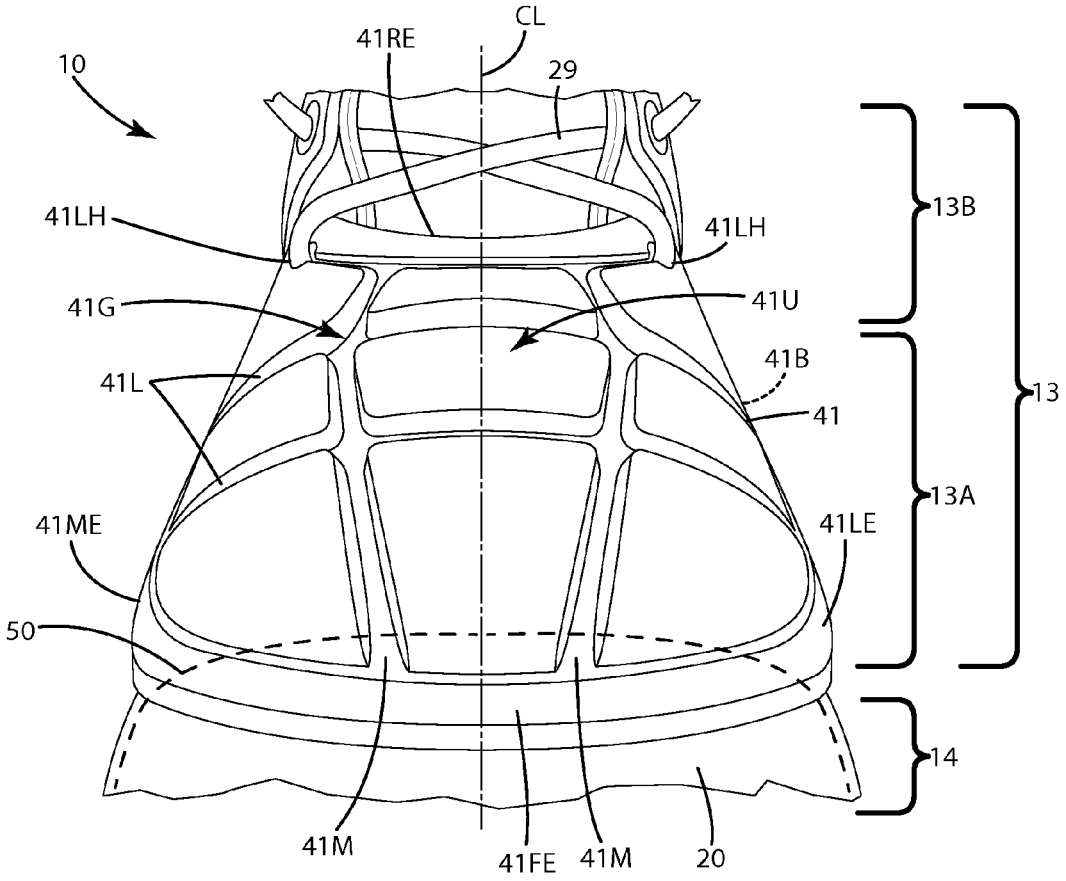
FIG. 3 is a close up view of a first metatarsal guard plate of the metatarsal guard assembly.
Figure 4:
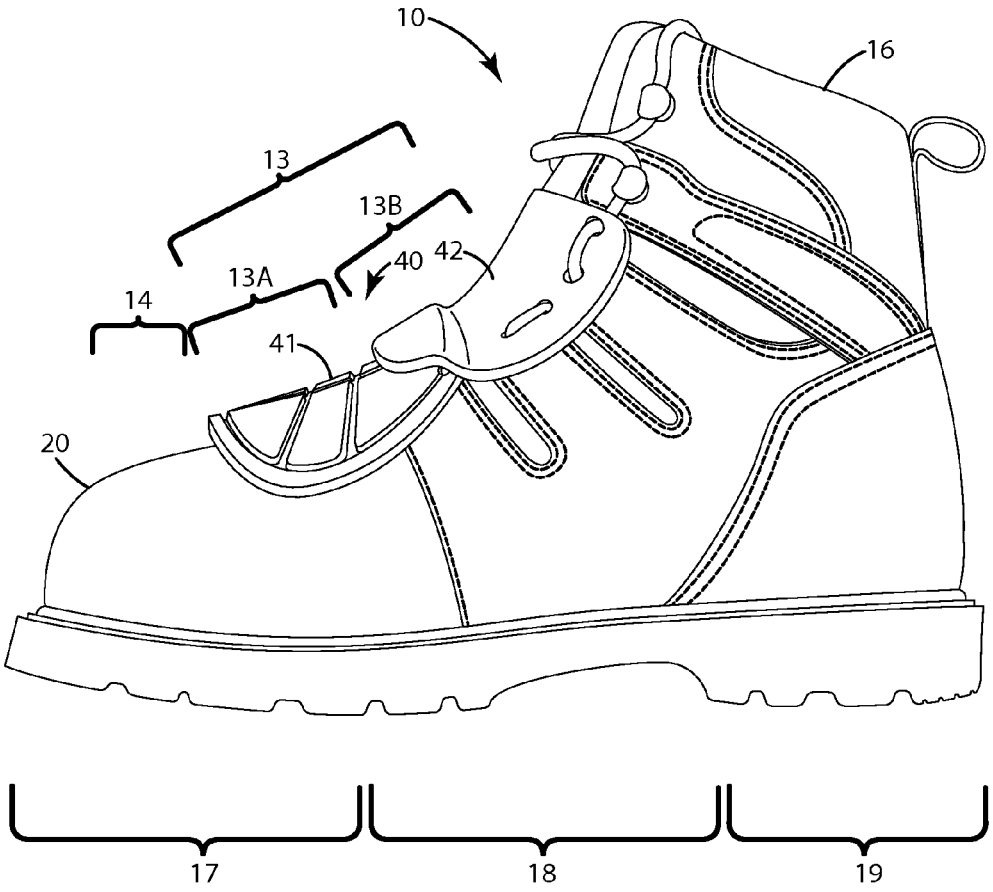
FIG. 4 is a side view of the footwear including the metatarsal guard assembly.

As illustrated in FIGS. 3-5, the upper 20 can include a toe region 14, which is immediately adjacent an instep region 13. Generally, toe region 14 shown in FIG. 5 covers the location of the upper where the toes T are located. The instep region 13 extends above a region of the wearer's foot when inserted in the footwear 10 that corresponds to the metatarsal bones MB of the wearer's foot. As mentioned above, these bones can be broken when impacted by objects dropped on the wearer's foot from above. Thus, the metatarsal guard assembly 40 herein provides enhances protection to these metatarsal bones MB in the instep region 13.

In addition, the footwear 10 optionally can be constructed to include a rigid protective toe element 50. This element can be a steel toe, but of course can be constructed from other materials. For example, it can be constructed from rigid polymeric materials of sufficient thickness to deflect forces and/or loads from objects dropped on the toe. The rigid toe protective element 50 can be configured to extend throughout the toe region 14 of the wearer's foot generally extending rearwardly toward the heel region 19 of the foot, but located substantially within the forefoot region 17 (FIG. 4) of the footwear 10.

The upper 20 can include an upper material 24 which can be any conventional upper material, such as leather, mesh, fabric, plastic, rubber or other materials. The upper 20 extends to and can be joined with the exterior surface of the protective toe element 50. The material 24 can extend upwardly toward the tongue 26 of the footwear. The tongue 26 can be constructed from a similar material but can include padding such as a flexible closed cell foam disposed therein. As illustrated, the uppermost portion of the material 24 is stitched with stitching 26S to the tongue 26. The tongue 26 can cover a tongue opening 260 defined in the upper portion of the upper 20.

In the construction as shown in FIG. 5, the metatarsal guard assembly 40 also includes an internal metatarsal guard 51. This internal metatarsal guard 51 can extend generally from a location above or adjacent the rigid protective toe element 50 upward toward the ankle opening 16 of the footwear 10, and can be attached to the interior surface 261 of the tongue 26. In the toe region 14, the internal metatarsal guard 51 can include an end 51E that is disposed or sandwiched between the rigid protective toe element 50 and the upper material 24. This end 51E can overlap the rigid protective toe element 50. Optionally, the internal metatarsal guard end 51E in this area can be adhered to both the outer surface of the rigid protective toe element 50 and the internal surface of the material 24. Adjacent the tongue 26, the internal metatarsal guard 51 can be stitched, glued, adhered or otherwise attached to the interior surface 261 of the tongue and adjacent portions of the upper that extend along the tongue opening 260. The internal metatarsal guard 51 can be constructed so that it does not move substantially relative to any of these components.

Figure 7:
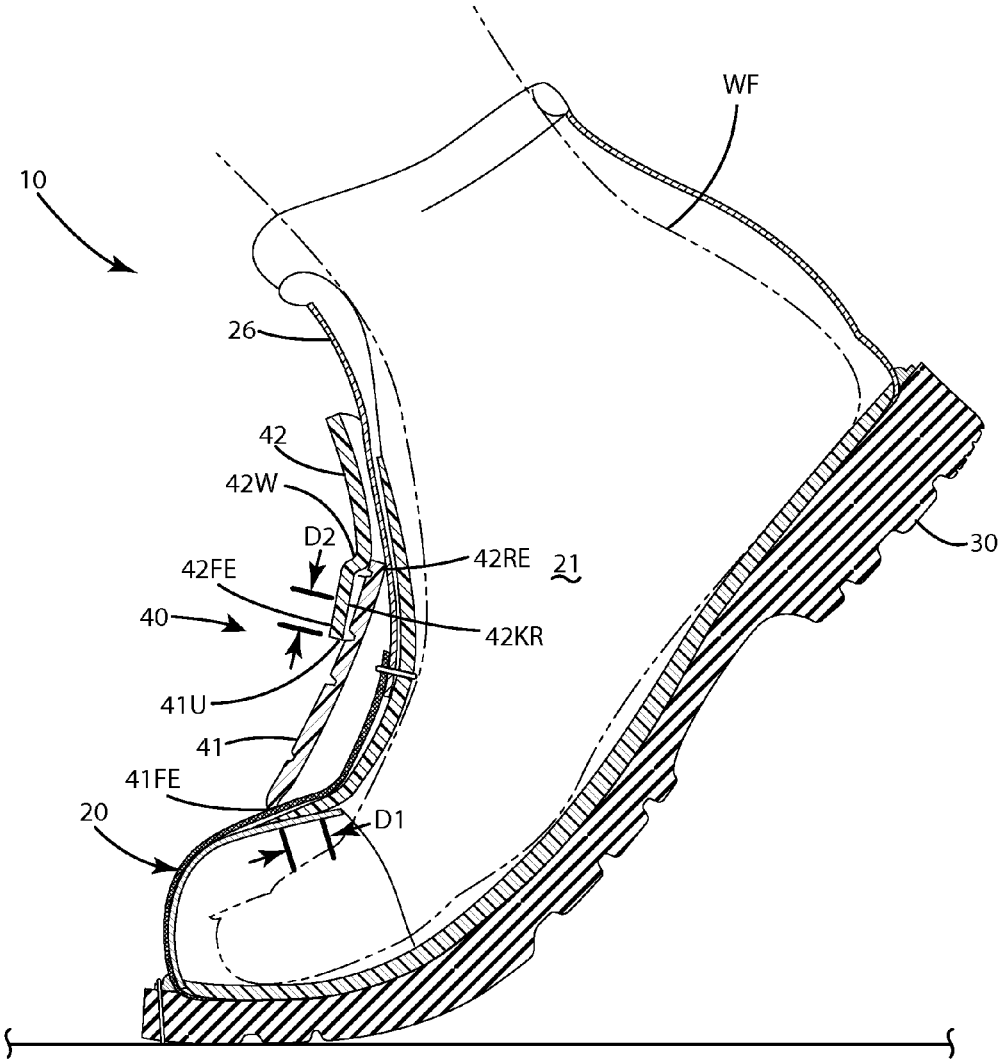
FIG. 7 is a section view of the footwear including the metatarsal guard assembly taken along lines 7-7 of FIG. 6, with the footwear in a flexed mode.

The construction of the internal metatarsal guard can be such that it still provides for enhanced flexibility and mobility to a wearer when the footwear moves from the static or flat mode shown in FIG. 5 to the flexed mode shown in FIG. 7. For example, the internal metatarsal guard can be constructed from a material such as cell, breathable foam. That material can have a density of optionally at least 9 lbs. per cubic foot, further optionally 9 lbs. per cubic foot to 25 lbs. per cubic foot, further optionally about 12 lbs. per cubic foot to about 20 lbs. per cubic foot and yet further optionally, about 15 lbs. per foot. It also can have a hardness or durometer of optionally 10 Shore O, further optionally 10 Shore O to 32 Shore O, further optionally 19 Shore O. Of course, other densities and durometers can be selected depending on the particular application. The material can have a tensile strength measured under ASTM D 3574 Test E of optionally 200 kPA to 1,000 kPa, further optionally 207 kPa to 965 kPa, even further optionally 310 kPa to 689 kPa, and even further optionally about 483 kPa. One type of open cell, breathable foam commercially available and suitable for the use in the current embodiments is sold under the trade name Poron® XRD™ Extreme Impact Protection foam, available from Rogers Corporation of Woodstock, Connecticut. Other foams, polymers, composites or materials may be substituted in this construction to provide an adequate internal metatarsal guard as desired.

Generally, the internal metatarsal guard 51 is separated from and does not contact or come into or directly engage the external metatarsal guards, for example the first external metatarsal guard 41 or the second external metatarsal guard 42. The internal and external metatarsal guards can be separated from the internal metatarsal guard via the upper material 24 and/or the tongue 26. In use, only the internal metatarsal guard 51 comes in contact with or engages the instep of the wearer's foot. The internal metatarsal guard usually can be configured so that it prevents the external metatarsal guards from contacting the foot or otherwise engaging the instep of the wearer's foot.

The internal metatarsal guard 51 can be of a saddle-type shape and configuration. For example, it is concave in extending from the toe region 14 toward the heel region, for example, as shown in FIG. 5. It also is convex across a width extending from a lateral side of the footwear to a medial side of the footwear. Of course, the shape can vary depending on the particular construction of the tongue 26 and the forward portion of the footwear extending over the instep region 13 and the toe region 14. As illustrated in FIG. 5, the internal metatarsal guard extends forwardly, optionally, into the toe region 14. It also extends rearwardly toward the heel through the instep region 13. Optionally, toward the edges of the internal metatarsal guard 51, the thickness T1 can diminish so that it provides a clean transition to adjacent components of the footwear. Of course, in some cases, the internal metatarsal guard can be substantially uniform in thickness so that even the edges are the same thickness as the remainder of the internal metatarsal guard 51.

As shown in FIG. 5, the instep region 13 can include a first or forward portion instep region 13A and a second or rearward instep region or portion 13B. The first instep portion 13A can be closer to the toe region than the second instep region Likewise, the second instep portion can be located farther away from the toe region than the first instep portion. Of course, the instep region 13 can be subdivided into more or fewer different regions, depending on the particular application, generally throughout the toe region and extending from the toe region toward the ankle opening 16. The upper 20 transitions upward from the outsole 30 over the rigid toe protective member 50 over the toe region 14 into the first instep portion 13A, at which point it generally transitions to a tongue 26 and through the second instep portion 13B. The remainder of the upper transitions upward to the ankle opening 16 from there.

As shown in FIGS. 1-3 and 5, the metatarsal guard assembly 40 includes a first external metatarsal guard plate 41, and an optional second external metatarsal guard plate 42. Generally, the first and second metatarsal guard plates are separately constructed and independent from one another. That is, they optionally can be formed as separate pieces or parts that are not connected to one another except after being assembled on the footwear. As shown in FIG. 3, the first external metatarsal guard plate 41 extends rearwardly from a toe region 14 toward and/or through the instep region 13. A majority of the first metatarsal plate 41 is located in the first instep region 13A, rather than the second instep region 13B. This is so that the second external metatarsal guard plate 42, when included, can extend over and generally be located in the second instep region 13B. The first external metatarsal guard can overlap at least a portion of the rigid toe protective element 50. As shown in FIG. 5, the first external metatarsal guard plate 41 also can overlap the internal metatarsal guard 51. Optionally, the first external metatarsal guard 41 can extend over and overlap a majority of the internal metatarsal guard 51. Further optionally, the second external metatarsal guard 42 can extend over a lesser or minor portion of the internal metatarsal guard 51 as shown in FIG. 5. Of course, in some applications the reverse can be true.

Returning to FIG. 3, the first external metatarsal guard plate 41 can extend between and can be bounded by one or more edges. For example, it can be bounded by a front edge 41FE and an opposing rear edge 41RE. The rear edge 41RE can be separated a distance from the front edge 41FE sufficient to cover a substantial portion of the first instep portion 13A and/or generally a majority of the instep region 13. The rear edge 41RE can be farther away from the toe region 14 than the front edge 41FE. The front edge 41FE can overlap slightly with the toe region 14 in some cases. The front edge 41FE can generally be of a curved or arcuate shape extending between lateral edge 41LE and opposing medial edge 41ME. These opposing side edges can respectively bound the sides of the first external metatarsal guard plate 41. These side edges 41LE and 41ME are shown as being arcuate or rounded. Of course, these edges, like the front and rear edges can be generally straight or angled depending on the particular application. The side edges 41LE and 41ME transition rearward to the rear edge 41RE and merge into that edge. The rear edge 41RE can have a similar curvature as the front edge 41FE.

The rear edge 41RE and/or portions of the side edges 41LE and/or 41ME can define lace holes 41LH, which are sized and oriented to accept shoelaces 29 from the footwear to which the first external metatarsal guard is attached. The lace holes can be disposed on opposite sides of the first external metatarsal guard 41, generally near the side edges 41LE and 41ME. Of course, in other constructions, these lace holes 41LH can be located closer to the center line CL of the boot or footwear 10 as desired. The lace holes 41LH can be sized to accept the shoelaces 29 therethrough. The lace holes can be of a rounded, circular or elliptical shape so as to cleanly receive the shoelaces, and to enable the shoelaces 29 to slide therethrough when being installed. Optionally, the lace hole 41LH of the first external metatarsal guard plate 41 can be perfectly aligned with underlying eyelets defined by the upper, adjacent the tongue opening 260. In this construction, the lace 29 can extend straight through the lace hole 41LH and directly into an underlying eyelet of the boot. In some cases, the eyelets can be constructed from metal, plastic or other rigid materials, or simply cut in the material from the upper is constructed. Further optionally, the lace holes 41LH can be defined through the body of the first plate 41. For example, the lace holes can extend generally from the upper surface 41U to the rear or back surface 41B of the body of the plate 41 itself—rather than being in the form of some secondary component extending from or attached to the plate 41.

As shown in FIG. 3, the first external metatarsal guard plate 41 can define a plurality of grooves 41G. These grooves 41G can include lateral grooves 41L that extend laterally and transversely to the center line CL of the footwear 10. These lateral grooves 41L can extend from adjacent the medial edge 41ME toward the lateral edge 41LE. The grooves 41L can be of a predefined depth, for example, about 0.5 mm to about 2.0 mm, or other depths, depending on the particular application. The grooves can be slightly rearward of the toe region 14 within the first instep portion 13A. There can be first and second sets of the lateral grooves 41L, one being closer to the toe region than the other. The lateral grooves 41L can improve the deflection of the plate 41 upon impact and can enable a slight bending of the first plate 41 as a user walks or moves through their natural gait cycle. The lateral grooves 41L can enable the front edge 41FE to come closer or approach the rear edge 41RE of the first guard plate 41 when the user flexes their foot, so that the toes of the wearer come closer to the ankle of the wearer during a gait cycle. Optionally, the grooves 41G can further include longitudinally extending grooves 41M. These longitudinally extending grooves 41 M can be transverse to the lateral grooves 41L. The grooves 41M can extend from the front edge 41FE toward the rear edge 41RE of the first external metatarsal guard plate 41. If desired, they can be offset at some angle relative to the centerline CL of the footwear. The longitudinal grooves 41M can provide additional flexibility to the first plate 41.

Optionally, the first metatarsal guard plate 41 can have several thicknesses. For example, near the lateral edge 41LE and the medial edge 41ME, the thickness can be less than the thickness along the center line CL of the footwear (other than where the grooves 41G are defined). In general, the thickness over the top of the footwear generally along the center line CL can be the greatest. This is so that when an object impacts the instep region 13, the plate 41 can provide enhanced protection to the metatarsal bones lying there beneath.

The front edge 41FE of the first metatarsal guard plate 41 is free from attachment to the upper or any other component of the footwear beyond the first metatarsal plate 41. The rear edge 41RE however, is attached to the upper and/or generally to some other footwear component. In this manner, the rear edge 41RE remains attached, while the front edge 41FE is allowed to slide over or relative to the upper or exterior surface of the upper in the instep region and/or the toe region. With this added mobility and movement of the first plate, it can enable the metatarsal guard to move quite easily during the natural gait cycle of a wearer. This in turn, can enhance the perceived flexibility of the footwear—even with the added protection over the instep via the metatarsal guard assembly 40. The first external metatarsal guard plate 41 includes an exterior or upper surface 41U as shown in FIG. 3. This upper surface 41U can be the portion of the plate 41 that faces exteriorly, away from the upper 20. The exterior surface 41U can follow a first concave contour. Opposite the upper or exterior surface 41U, the plate can define a back or rear side 41B. The rear side 41B also can follow a concave contour, however, it can be slightly less concave than the upper surface 41U to provide suitable additional deflection characteristics in some applications.

As shown in FIG. 5, the rear edge 41RE of the first rigid external metatarsal plate 41 can extend beyond the end of the material 24 and over at least a portion of the tongue opening 260. Of course, in other applications, the rear edge 41RE can terminate short of the tongue opening 260. In other applications, the footwear may not include a tongue opening 260, in which case the rear edge 41RE simply extends upwardly over at least a portion of the instep region 13.

The first external metatarsal guard plate 41 can be constructed from a variety of materials. These materials can be substantially rigid and generally inflexible except under significant force. For example, the plates can be constructed from a thermoplastic material. Some examples include, but are not limited to, polypropylene, polyethylene, nylon, ABS, polycarbonate, polystyrene, polyvinylchloride, Teflon or other polymeric materials. If desired, the plates alternatively can be constructed from metals, composites, glass or fiber reinforced materials and the like. Further, the separately constructed first and second plates can be formed from entirely different materials in some applications. Generally, in most applications, both plates can be constructed from the same material for ease of manufacture and assembly.

Figure 2:
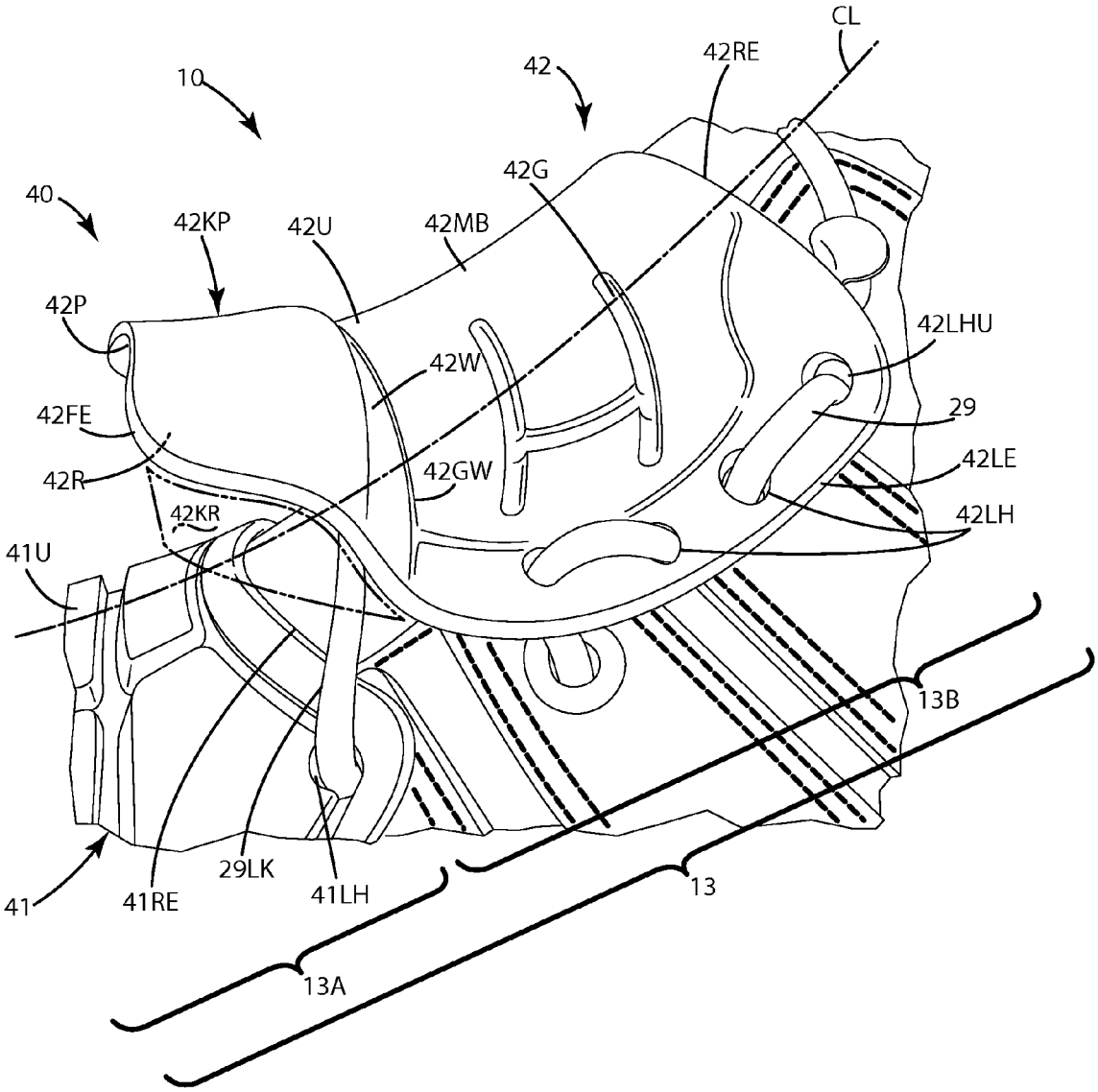
FIG. 2 is a close up view of a first and second metatarsal guard plates of the metatarsal guard assembly.

As mentioned above, the metatarsal guard assembly 40 includes a second external metatarsal guard plate 42. This second external metatarsal guard plate 42 can be constructed from materials such as those enumerated above in connection with the first external metatarsal guard plate 41. The second external metatarsal guard plate 42 can include a front edge 42FE and a rear edge 42RE. The front edge 42FE is closer to the toe region 14 than the rear edge 42RE. The front edge 42RE can be generally rounded or arcuate in shape. Of course, it can optionally be slightly angled if desired. Further, the front edge, as shown in FIGS. 1 and 2 can include a recess 42P along the front edge. This recess 42P can enable the front edge to rest against and be closer to the first external metatarsal guard plate 41, generally because the uppermost surface of the 41U of the first plate 41 is arcuate or convex. In this manner, the recess 42P, which can be concave, can interfit over the convex upper surface 41U of the first plate 41, so that overall, the second plate 42 has a more flush and lower profile relative to the first plate 41, even when the second plate 42 rides or slides over the upper surface 41U of the first plate.

The second external metatarsal guard plate 42 also can include a lateral edge 42LE and a medial edge 42ME that are generally opposed, across opposite sides of a center line CL of the footwear. These side edges 42ME and 42LE can generally merge into the front edge 42FE and rear edge 42RE respectively.

The side edges 42ME and 42LE can define a plurality of lace holes 42LH. These lace holes can be located along the outermost perimeters of the second plate 42. Optionally, the uppermost lace holes 42LHU can be defined at least partially in or at least near the rear edge 42RE of the second metatarsal plate 42. The front edge 42FE of the second metatarsal guard plate 42 is free from attachment to the upper or any other component of the footwear beyond the second metatarsal plate 42. The rear edge 42RE however, is attached to the upper and/or generally to some other footwear component. In this manner, the rear edge 42RE remains attached, while the front edge 42FE is allowed to slide over or relative to the upper or exterior surface of the upper in the instep region and/or the toe region. With this added mobility and movement of the second plate, it can enable the metatarsal guard to move quite easily during the natural gait cycle of a wearer. This in turn, can enhance the perceived flexibility of the footwear—even with the added protection over the instep via the metatarsal guard assembly 40.

Optionally, the second external metatarsal guard plate 42 can define a keeper recess 42KR as shown in broken lines in FIG. 2. There, the keeper recess 42KR is located rearward of the front edge 42FE of the second plate 42. This keeper recess 42KR can generally be sized and configured to receive and conceal at least a portion of the rear edge 41RE of the first plate 41. The keeper recess 42KR can also provide clearance for the laces 29LK that are located at the rear edge 41RE of the first plate. This in turn can reduce the abrasion of those laces 29LK. The keeper recess 42KR can provide a slight recess within which the lace 29LK can be disposed without the surfaces of the second plate 42 rubbing against or engaging those laces 29LK in use.

Optionally, the second external metatarsal guard plate 42 is of a substantially uniform thickness from the front edge 42FE to the rear edge 42RE. In some embodiments, the thicknesses can be optionally 0.5 mm to 3 mm, further optionally 1 mm to 2 mm. Of course, other thicknesses can be utilized as depending on the particular application. Further optionally, there can be grooves 42G formed in the upper surface 42U of the second plate 42. The upper surface 42U is opposite a lower or rear surface 42R. This rear surface 42R, particularly along the front edge 42FE is configured to engage and slide along or relative to the upper surface 41U of the first plate 41.

The keeper recess 42KR can be formed by an upwardly extending wall 42W that extends from a main body portion 42MB of the second plate 42. This upwardly extending wall 42W can extend at an angle or generally can be curved or rounded upwardly, away from the main body 42MB. This upwardly extending wall 42W can transition to a keeper plate 42KP that extends outwardly and forwardly to the front edge 42FE of the second plate. Adjacent the upstanding wall 42W, a laterally extending groove 42GW can be defined by the plate. This groove 42GW can enable the keeper plate to flex slightly upwardly upon or during a wearer's natural gait to provide enhanced flexibility to the second plate and generally to the metatarsal guard assembly 40. Optionally, the thickness throughout the main body 42MB, the upstanding wall 42W and the keeper plate 42KP can be substantially consistent.

Operation of the footwear 10 and the metatarsal guard assembly 40 in general will now be described. In general, the footwear 10 is worn by a wearer, optionally to provide added safety and protection to the metatarsal bones MB of the wearer's foot in the instep region 13 as shown in FIG. 5. The wearer's foot WF is placed on the interior 21 of the upper 20. Accordingly, the wearer's foot and particularly the instep of the wearer's foot, is placed immediately adjacent the internal metatarsal guard 51. The toes T of the wearer fit within the rigid protective toe element 50. The external metatarsal guards 41 and 42 are placed distal from the wearer's foot, generally separated therefrom by at least the internal metatarsal guard 51 and portions of the tongue 26 and/or forward portion of the upper material 24.

Figure 6:
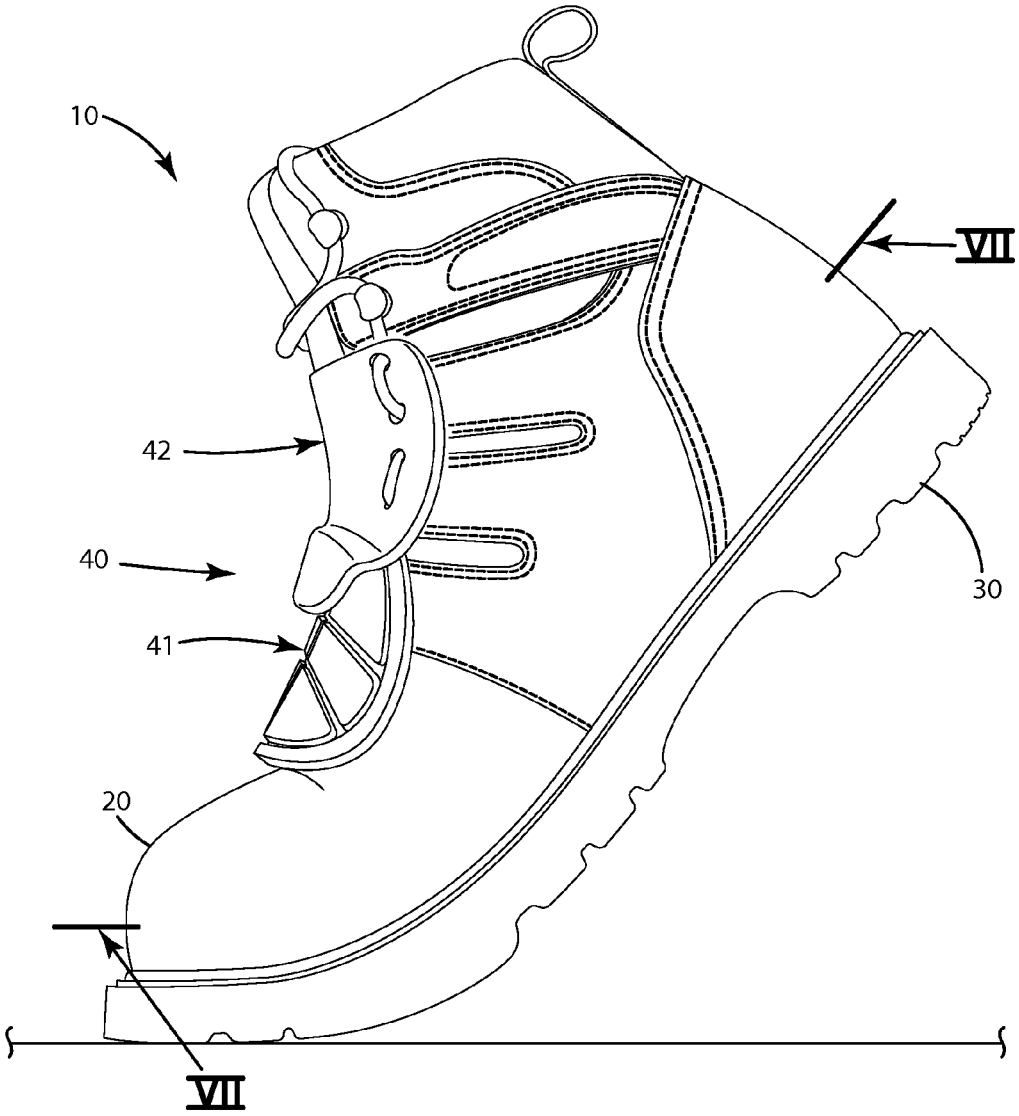
FIG. 6 is a side view of the footwear including the metatarsal guard assembly in a flexed mode.

As shown in FIG. 5, the wearer's foot WF is generally in a static or flat mode. The metatarsal guard assembly 40 extends over the instep and metatarsal bones MB of the wearer's foot WF. When the wearer desires to walk in a natural gait, however, the wearer's foot transitions from the flat or static mode shown in FIG. 5 to the flexed or bent mode as shown in FIGS. 6 and 7. When this occurs, the metatarsal guard assembly 40 operates in a manner to provide enhanced mobility and flexibility to the instep of the wearer, allowing the wearer's foot to move more naturally, which contrasts conventional metatarsal guards that are substantially rigid and promote an awkward, inflexible and/or clumsy motion of the wearer's foot during a normal gait cycle.

As shown in FIG. 7, the guard assembly 40 includes the first external metatarsal guard plate 41 and the second external metatarsal guard plate 42. Both of these are attached to the upper along their respective rear edges and/or side edges with regard to the second plate as described above. Upon flexion, the front edge 41FE of the first metatarsal guard 41 slides forwardly a distance D1 over the external surface of the upper 20. This sliding again is promoted by the freedom from attachment of the front edge 41FE to the upper or any components other than the remainder of the body of the first plate 41. The rear edge of the plate 42RE, however, remains generally static and stationary relative to the remainder of the footwear due to its attachment via shoe laces to the upper 20.

The second plate 42 also can dynamically move. For example, while the side edges 42LE and 42 ME remain attached via shoe laces to the upper, the front edge 42FE, which is free from attachment to the upper and the first plate 41 slides forwardly a distance D2 relative to the upper exterior surface of the first external metatarsal guard 41, generally toward the toe region 14 of the footwear. This sliding movement of the second plate relative to the first plate generally mimics movement of individual plates, for example, in a lobster tail. This type of movement herein is referred to as a lobster tail articulation. Those first and second external metatarsal guards thus move relative to one another via a lobster tail articulation. This in turn promotes flexibility to the instep region of the footwear so that the footwear can actually bend somewhat unimpeded by the metatarsal guard assembly 40. This can provide added mobility and flexibility to the wearer's foot, even while the wearer's foot is protected via the metatarsal guard assembly 40. In addition, the front edge 41FE slides relative to the outer surface or exterior of the upper. This acts somewhat like a lobster tail as well, however, the upper 41 itself does not slide relative to any other components.

In addition, in the flexing mode, the rear edge 42RE can optionally exit the keeper recess 42KR, and/or can disengage the undersurface of the keeper plate 42KP. When this occurs, the rear edge 41RE can sometimes disengage the undersurface of the keeper plate 42KP and can ride rearward, past the wall 42W. The front edge 42FE, however, can maintain contact with the upper surface 41U of the first plate 41. Further, the upper surface 41U can ride or slide within the front recess 42P along the front edge 42FE when included. Again, with this movement of the different metatarsal guard plates 41 and 42, the footwear is provided with enhanced flexibility and mobility.

Even with the enhanced flexibility and mobility, the superguard provides exceptional protection to the instep. For example, the footwear of the embodiments herein has been tested according to standardized test ASTM F2412-11:7.5. This test is designed specifically to test metatarsal guards and footwear for impact absorption and clearance after impact. Generally, the clearance C is measured as shown in FIG. 5. The clearance C can be the distance above the instep of a wearer's foot immediately after the impact during the aforementioned ASTM test. The acceptable standard of the impact clearance under the aforementioned ASTM test is 1 inch.

Surprisingly and unexpectedly, the metatarsal guard system herein has exhibited a range of clearance under the ASTM test of optionally at least 1.50 inches above a wearer's foot; further optionally, at least 1.52 inches above a wearer's foot, and even further optionally at least 1.63 inches above a wearer's foot. It was discovered that the external metatarsal guard and internal metatarsal guard acted synergistically with one another to enhance the overall protection and clearance provided under the aforementioned ASTM test. Indeed, the tested footwear exhibited an improvement of at least 150%, at least 152%, or at least 163% over the standard of the ASTM test. Thus, with the metatarsal guard assembly herein, the footwear provides substantial protection to the wearer without sacrificing comfort and flexibility.

Figure 8:
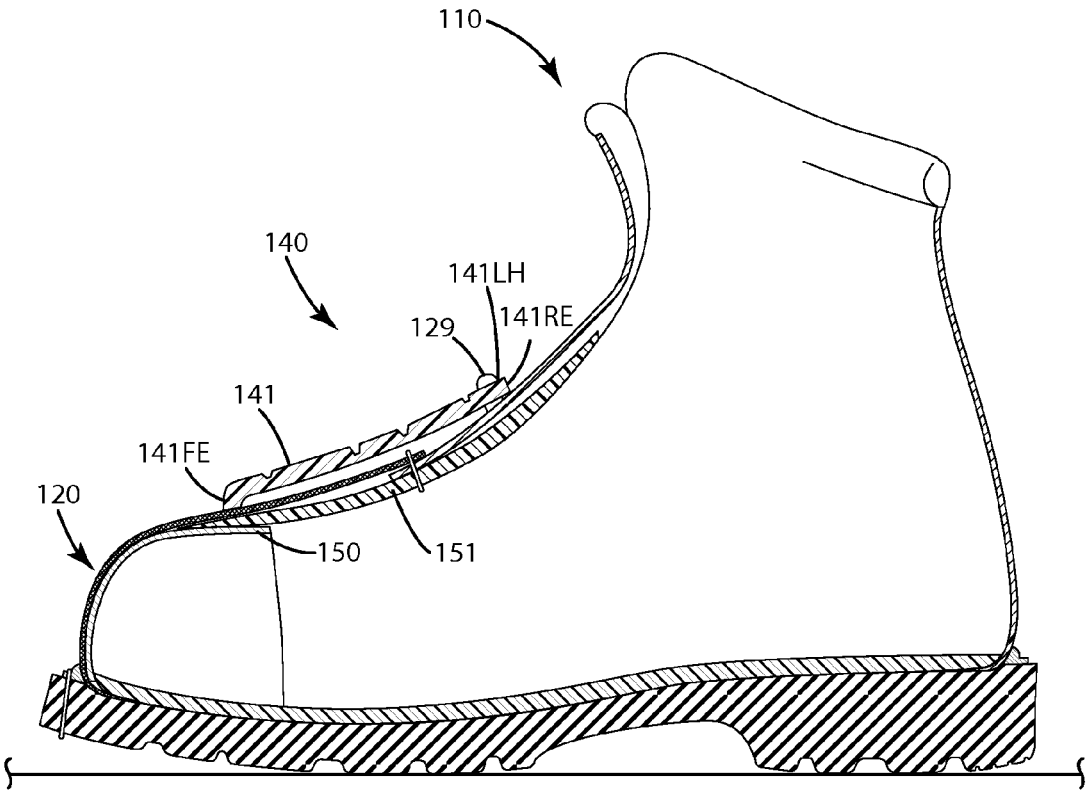
FIG. 8 is a section view of a first alternative embodiment of the footwear including a modified metatarsal guard assembly.

A first alternative embodiment of the footwear is illustrated in FIG. 8 and generally designated 110. This embodiment is similar to the above embodiment in function, structure and operation with several exceptions. For example, the metatarsal guard assembly 140 includes a single external metatarsal guard 141 and an internal metatarsal guard 151. There is no second external metatarsal guard. In this embodiment, the front edge 141FE of the first metatarsal guard 141 is free from attachment to the upper, while the rear edge 141RE is attached via shoe laces 129 to the upper. In this structure, the external metatarsal guard 141 also overlaps the internal metatarsal guard 151 a substantial amount. In addition, both the internal and external metatarsal guards can overlap at least a portion of the rigid toe protector element 150. The function and operation of this metatarsal guard is similar to that of the above without the second metatarsal guard plate, and therefore will not be described again in detail here.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper including an instep region located rearward of a toe region, an outsole joined with the upper;

a rigid toe protective element disposed in the toe region of the upper;

an internal metatarsal guard disposed in an interior of the upper;

a first external metatarsal guard movably joined with the upper, on an exterior of the upper;

a second external metatarsal guard, on the exterior of the upper, movably joined with the upper, and overlapping the first external metatarsal guard so that upon flexing of the instep region during a gait cycle of a wearer, the second external metatarsal guard rides along the first external metatarsal guard via lobster tail articulation of the first and second external metatarsal guards relative to one another, wherein a first external metatarsal guard front edge slides forwardly along an exterior surface of the upper during the gait cycle of the wearer, and thus moves relative to the rigid protective toe element, wherein the upper defines a centerline that bisects the upper, wherein the second external metatarsal guard defines a lace hole through which a shoe lace is disposed to secure the second metatarsal guard to the upper along a lateral edge of the second external metatarsal guard, wherein the shoe lace is disposed over an upper surface of the second metatarsal guard adjacent the lateral edge, without the shoe lace crossing the centerline over the upper surface to extend to a medial edge of the second metatarsal guard.

2. The article of footwear of claim 1, wherein the internal metatarsal guard, first external metatarsal guard and second internal metatarsal guard cooperate to provide clearance of at least 1.50 inches above a wearer's foot, wherein the second metatarsal guard includes a lower surface, wherein the shoe lace crosses the center line under the lower surface.

3. The article of footwear of claim 1, wherein the rigid protective element is a steel toe disposed in the toe region, wherein the first external metatarsal guard and the internal metatarsal guard each overlap the steel toe.

4. The article of footwear of claim 1, wherein each of the lateral edge and the medial edge are free from attachment to the upper except for the shoe lace extending between the upper and the second external metatarsal guard.

5. An article of footwear comprising:

an upper including an upper instep region located rearward of a toe region, the upper including an exterior surface and defining an interior, the upper instep region including a first instep portion and a second instep portion, the second instep portion being located farther away from the toe region than the first instep portion;

a rigid toe protective element disposed in the toe region of the upper;

an outsole joined with the upper;

a metatarsal guard assembly disposed in the upper instep region, the metatarsal guard assembly comprising:

an internal metatarsal guard plate constructed from an open cell, breathable foam, the internal metatarsal guard plate disposed in the interior of the upper;

a first external metatarsal guard plate constructed from a rigid thermoplastic material, the first external metatarsal guard being disposed over the first instep portion, the first external metatarsal guard including a first front edge, an opposing first rear edge, and a first medial edge and a first lateral edge extending between the first front edge and first rear edge, the first front edge being closer to the toe region than the opposing first rear edge, the first front edge being free from attachment to the upper and the exterior surface, the opposing first rear edge being joined via a shoe lace to the upper;

a second external metatarsal guard plate constructed from the rigid thermoplastic material, the second metatarsal guard plate being separately constructed and independent from the first external metatarsal guard plate, the second external metatarsal guard being disposed over the second instep portion, the second external metatarsal guard including a second front edge and an opposing second rear edge, the second front edge being closer to the toe region than the opposing second rear edge, and a second medial edge and a second lateral edge extending between the second front edge and second rear edge, the second front edge being free from attachment to the upper and the exterior surface, at least one of the opposing second rear edge, the second medial edge and the second lateral edge being joined with the shoe lace to the upper, wherein the first front edge overlaps the rigid toe protective element, wherein at least one of the first external metatarsal guard plate and the second external metatarsal guard plate overlap the internal metatarsal guard plate, wherein the second front edge overlaps the first rear edge so that during a gait cycle of a wearer of the footwear, the second front edge slides forwardly over an upper surface of the first external metatarsal guard toward the toe region, whereby the first and second external metatarsal guards provide flexibility to the instep region of the footwear via lobster tail articulation of the first and second external metatarsal guards relative to one another.

6. The article of footwear of claim 5, wherein the second external metatarsal guard defines a keeper recess adjacent the second front edge, wherein the keeper recess is configured to receive within the keeper recess at least the first rear edge of the first external metatarsal guard.

7. The article of footwear of claim 5, wherein the internal metatarsal guard plate overlaps the rigid toe protective element, wherein the first external metatarsal guard slides forwardly above the rigid toe protective element during the gait cycle of a wearer of the footwear.

8. The article of footwear of claim 5, wherein the shoe lace joins the second medial edge and the second lateral edge of the second external metatarsal guard to the upper.

9. The article of footwear of claim 5, wherein at least one of the first and second external metatarsal guards include an upper surface, the upper surface defining a plurality of grooves that enable the at least one of the first and second external metatarsal guards to flex during the gait cycle, whereby the plurality of grooves enhance the flexibility of the at least one of the first and second external metatarsal guards.

10. The article of footwear of claim 5, wherein the first rear edge of the first external metatarsal guard defines at least two lace holes, a first hole near the first medial edge, and a second hole adjacent the first lateral edge, wherein the shoe lace is laced through the first hole and the second hole.

11. The article of footwear of claim 5, wherein the internal metatarsal guard, first external metatarsal guard and second internal metatarsal guard cooperate to provide clearance of at least 1.50 inches above a wearer's foot.

12. The article of footwear of claim 11, wherein the internal metatarsal guard, first external metatarsal guard and second internal metatarsal guard cooperate to provide clearance of at least 1.63 inches above a wearer's foot.

13. An article of footwear comprising:

an upper including an upper instep region located rearward of a toe region, the upper including an exterior surface and defining an eyelet;

an outsole joined with the upper;

an internal metatarsal guard disposed in an interior of the upper;

a first rigid external metatarsal guard including a first front edge being free from attachment to the upper and an opposing first rear edge being joined via a shoe lace to the upper;

a second rigid external metatarsal guard including a second front edge being free from attachment to the upper and at least one of an opposing second rear edge, a second medial edge and a second lateral edge being joined with the shoe lace to the upper, wherein at least one of the first external metatarsal guard and the second external metatarsal guard overlap the internal metatarsal guard, wherein the second front edge overlaps the first rear edge so that during a gait cycle of a wearer of the footwear, the second front edge slides forwardly over an upper surface of the first external metatarsal guard toward the toe region, whereby the first and second external metatarsal guards provide flexibility to the instep region of the footwear via lobster tail articulation of the first and second external metatarsal guards relative to one another;

wherein at least one hole is defined adjacent the first rear edge of the first rigid external metatarsal guard, wherein the shoe lace is disposed through the at least one hole to join the first rigid external metatarsal guard to the upper, wherein the first rigid external metatarsal guard includes an interior surface, wherein the interior surface is disposed adjacent and engages the exterior surface of the upper, wherein the at least one lace hole defined by the first rear edge of the first rigid external metatarsal guard is disposed over the eyelet of the upper, the eyelet underlying the at least one lace hole defined by the first rigid external metatarsal guard.

14. The article of footwear of claim 13, wherein the second external metatarsal guard is a plate of a substantially uniform thickness, wherein the plate includes an upwardly extending wall near the second front edge, the upwardly extending wall transitioning to a keeper plate, wherein the upwardly extending wall and the keeper plate collectively define a keeper recess that is formed on an underside of the second external metatarsal guard.

15. The article of footwear of claim 14 wherein the first rear edge is disposed in the keeper recess when the footwear is in a flat mode.

16. The article of footwear of claim 15 wherein the keeper plate slides forwardly away from the first rear edge toward the toe region when the footwear is in a flexing mode.

17. The article of footwear of claim 13 wherein the internal metatarsal guard is in the form of an arcuate plate constructed from a closed cell, breathable foam having a durometer in the range of 10 Shore O to 32 Shore O.

18. The article of footwear of claim 13, wherein the upper includes a tongue disposed at least partially in the upper instep region, wherein the internal metatarsal guard is disposed under the tongue, generally between the tongue and the foot of a wearer of the footwear.

19. The article of footwear of claim 13 wherein the internal metatarsal guard and the first rigid external metatarsal guard are on opposite sides of an instep piece of material forming the upper.

* * * * *